US007419240B2

(12) United States Patent
Nakashima

(10) Patent No.: US 7,419,240 B2
(45) Date of Patent: Sep. 2, 2008

(54) PRINT HEAD CAP

(75) Inventor: Atsuhisa Nakashima, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 288 days.

(21) Appl. No.: 10/809,341

(22) Filed: Mar. 26, 2004

(65) Prior Publication Data

US 2004/0189738 A1 Sep. 30, 2004

(30) Foreign Application Priority Data

Mar. 27, 2003 (JP) ..... 2003-088717

(51) Int. Cl.
*B41J 2/165* (2006.01)

(52) U.S. Cl. ..... 347/29; 347/30

(58) Field of Classification Search ..... 347/29, 347/30

See application file for complete search history.

(56) References Cited

U.S. PATENT DOCUMENTS

| | | | | |
|---|---|---|---|---|
| 5,448,270 | A | 9/1995 | Osborne | |
| 6,068,364 | A * | 5/2000 | Kusumi et al. | 347/29 |
| 6,203,136 | B1 * | 3/2001 | Takahashi et al. | 347/32 |
| 6,517,185 | B1 | 2/2003 | Aldrich | |
| 6,793,317 | B2 * | 9/2004 | Shima | 347/29 |

FOREIGN PATENT DOCUMENTS

| | | |
|---|---|---|
| EP | 0 744 294 A1 | 11/1996 |
| EP | 1 074 388 A1 | 2/2001 |
| JP | A 5-193150 | 8/1993 |
| JP | A 9-39258 | 2/1997 |
| JP | A 10-211711 | 8/1998 |
| JP | A 2002-172794 | 6/2002 |
| JP | A-2004-136512 | 5/2004 |

OTHER PUBLICATIONS

Chinese Office Action for Application No. 200410031381.6 (w/English Translation); Jul. 14, 2006.
Japanese Patent Office Action for Application No. 2003-088717; Aug. 29, 2006.

* cited by examiner

*Primary Examiner*—Stephen D. Meier
*Assistant Examiner*—Geoffrey Mruk
(74) *Attorney, Agent, or Firm*—Oliff & Berridge, PLC

(57) ABSTRACT

A print head cap includes a bottom surface; and a ring-like lip. The ring-like lip surrounds the bottom surface, protrudes toward a nozzle surface of a print head of an ink jet printer and is elastically deformable. The ring-like lip is pressed onto the nozzle surface to cover the nozzle surface therewith. The ring-like lip has corners that change the direction surrounding the bottom surface. The corners of the ring-like lip are more elastically deformable than the other portions of the ring-like lip.

13 Claims, 5 Drawing Sheets

PRINT HEAD CAP

BACKGROUND OF THE INVENTION

1. Field of the Invention

The present invention relates to a print head cap for covering a nozzle surface therewith at the time of recovering a print head for ejecting ink droplets onto printing paper or at the time of keeping the print head moist.

2. Background Art

In the related art, as disclosed in JP-A-5-193150, there has been known a cap having a box-like sealing portion, a thick portion formed in the outer circumference of the sealing portion and a thin portion coupling the sealing portion with the thick portion. In order to improve the sealing performance of the cap pressed onto the nozzle surface of a print head, the cap is adapted so that the thin portion is deformed when the sealing portion is pressed onto the nozzle surface, so that the sealing portion is equalized and brought into tight contact with the nozzle surface.

In addition, as disclosed in JP-A-10-211711, the cap is formed into a rectangular box-like shape corresponding to the shape of the nozzle surface.

SUMMARY OF THE INVENTION

In such a related-art rectangular cap, particularly in such a cap for use in a full-line type print head in which a plurality nozzles are arrayed all over the width-direction area of printing paper, precision in flatness, dimensions and the like has to be high enough when the size of the print head in the direction in which the nozzles are arrayed is large and the cap is brought into tight contact with the nozzle surface uniformly. However, since the cap is formed out of an elastic body of rubber or the like, it is difficult to manufacture the cap particularly into such a high-precision shape. Thus, it is difficult to retain air-tightness required in the cap. In addition, since defective caps are often manufactured, there is also a problem that the yield in manufacturing deteriorates.

A print head cap is disclosed herein, in which air-tightness can be retained while the yield in manufacturing can be improved.

According to one aspect of the invention, a print head cap includes: a bottom surface; and a ring-like lip surrounding the bottom surface like a ring and protruding toward a nozzle surface of a print head of an inkjet printer and being elastically deformable, the ring-like lip to be pressed onto the nozzle surface to cover the nozzle surface therewith. The ring-like lip has corners that change a direction of surrounding the bottom surface. The corners are more elastically deformable than the other portion of the ring-like lip.

According to another aspect of the invention, a print head cap includes: a bottom surface; and an elastically deformable lip surrounding the bottom surface like a ring and protruding toward a nozzle surface of a print head of an ink jet printer, the lip to be pressed onto the nozzle surface to cover the nozzle surface therewith. The lip has a plurality of side lips and a plurality of corner lips connecting the side lips with each other and changing a direction of surrounding the bottom surface. At least one of the plurality of corner lips is formed into an arc-like shape swelling outward and is formed to be lower in height than the side lips.

BRIEF DESCRIPTION OF THE DRAWINGS

The present invention may be more readily described with reference to the accompanying drawings.

DETAILED DESCRIPTION OF THE PREFERRED EMBODIMENTS

Embodiments of the invention will be described below in detail with reference to the drawings.

Figure 1:
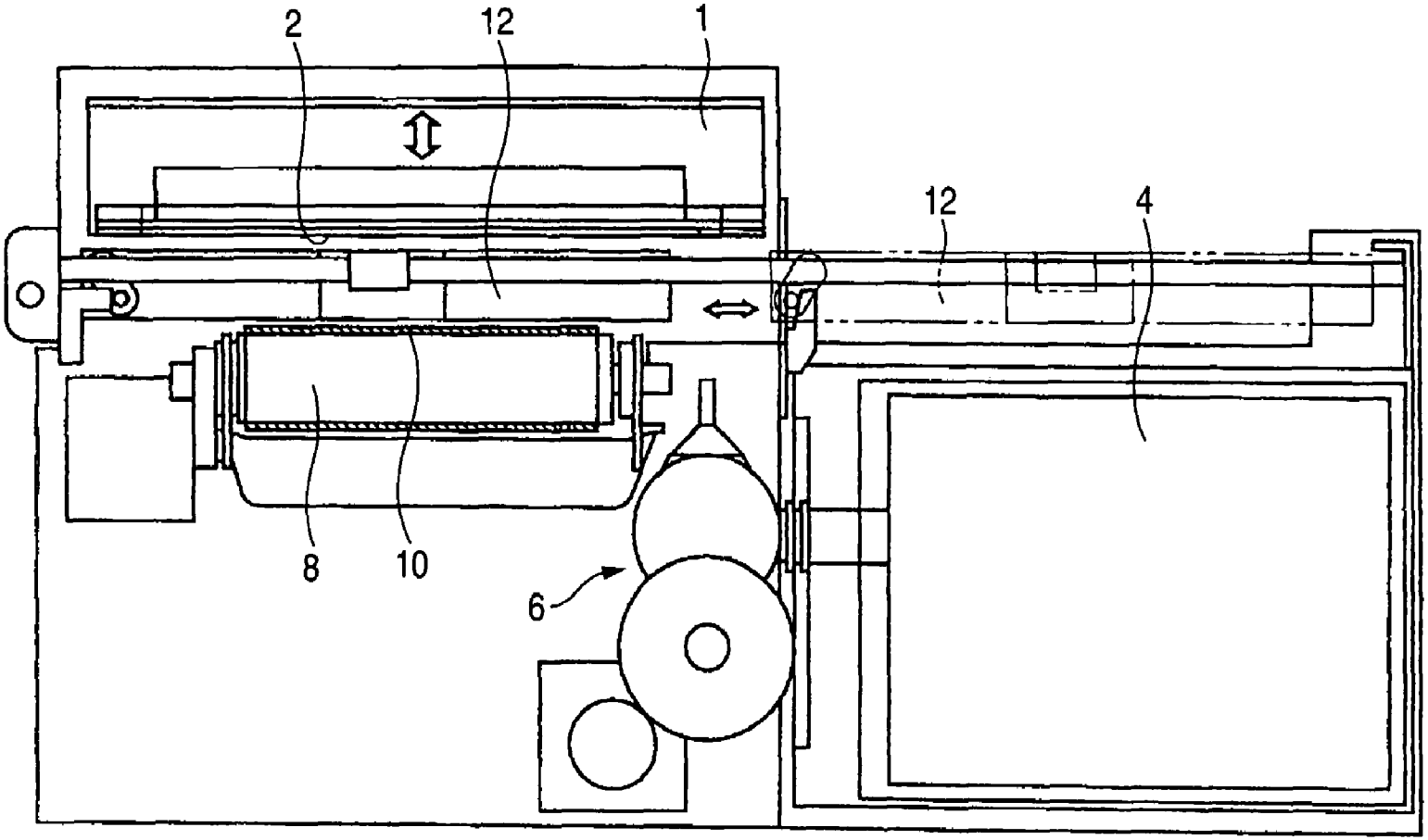
FIG. 1 is a configuration diagram of a printer using a print head cap according to a first embodiment of the invention.

As shown in FIG. 1, a printer according to this embodiment has a full-line type print head 1, and a large number of not-shown nozzles are formed in the print head 1 in a direction perpendicular to the direction of feeding printing paper. A nozzle surface 2 in which the nozzles are opened is disposed to be opposed to the printing paper.

In addition, the print head 1 is of an ink jet system for ejecting ink droplets onto the printing paper. For example, such a print head 1 is provided for respective colors of yellow, magenta, cyan and black. Incidentally, each part of the print head 1 is supplied with its corresponding color ink from an ink cartridge 4 through an ink supply mechanism 6.

The printing paper is fed in tight contact with the surface of a belt 10 laid between a pair of rollers 8 (only one of which is shown). Each print head 1 is disposed in a body case 11 movably in a direction perpendicular to the surface of the belt 10 on which the paper is mounted. At the time of carrying out printing, the print head 1 is moved to an ink ejection position close to the printing paper. At the time of maintenance, the print head 1 is moved to a standby position in which a predetermined space is formed between the print head 1 and the printing paper and which is more distant from the belt 10 than the ink ejection position, as shown in FIG. 1.

Figure 2:
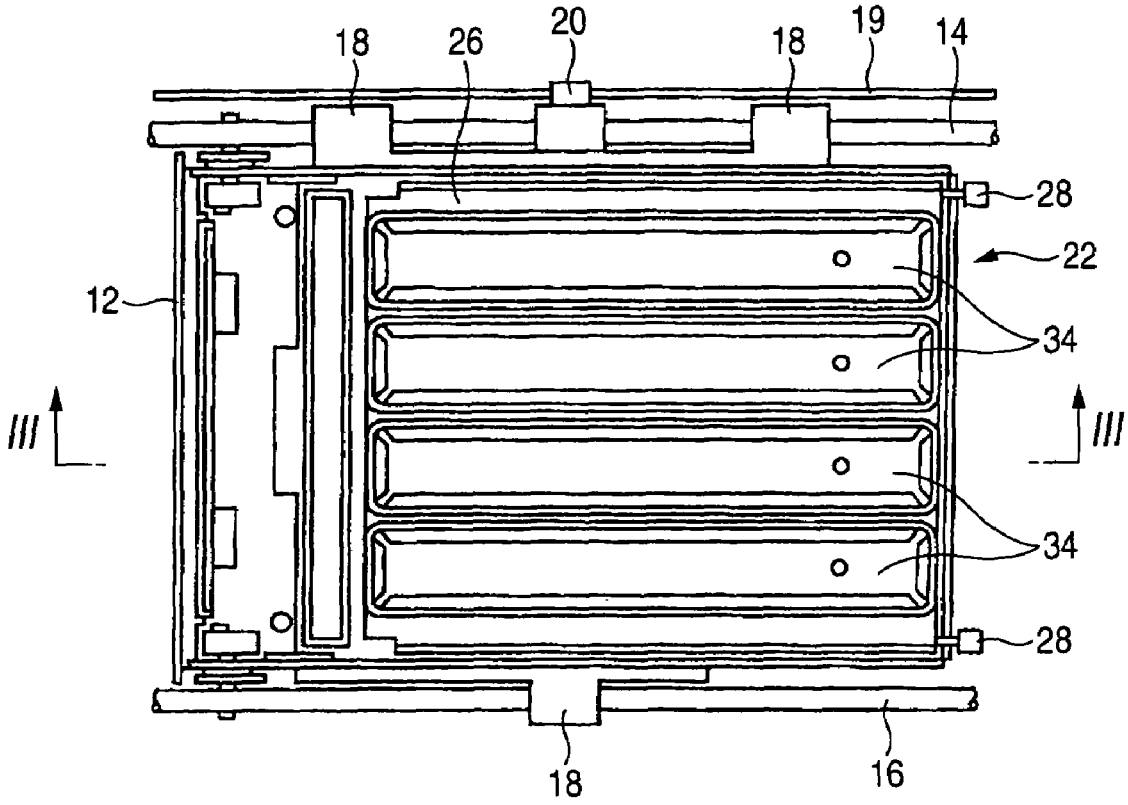
FIG. 2 is a plan view of a capping mechanism using the print head cap according to the embodiment.

A mounting base 12 which can be inserted into this space is provided. As shown in FIG. 2, the mounting base 12 is supported on a pair of guide bars 14 and 16 through a plurality of sliding members 18 so that the mounting base 12 can move forward/backward linearly. The guide bars 14 and 16 are disposed perpendicularly to the direction of feeding the printing paper (direction perpendicular to the paper surface of FIG. 1). A belt 19 is laid in parallel with the guide bars 14 and 16. The mounting base 12 and the belt 19 are fastened to each other through a lock member 20.

When the belt 19 is driven by a motor, the mounting base 12 slides along the guide bars 14 and 16 so that the mounting base 12 can move forward/backward between a maintenance position (position designated by the solid line in FIG. 1) in which the mounting base 12 is inserted into the space between the print head 1 and the printing paper and are traction position (position designated by the chain double-dashed line in FIG. 1) in which the mounting base 12 is retracted from the space to the upper side of the ink cartridge 4 at the time of printing.

A capping mechanism 22 is mounted on the mounting base 12. The capping mechanism 22 has a plurality of links 24 one ends of which are supported swingably on the mounting base 12, and a cap base 26 on which the other ends of the plurality of links 24 are supported swingably. The cap base 26 is configured as follows. That is, when the mounting base 12 is moved to the maintenance position, each engagement portion 28 integrated with the cap base 26 abuts against a fixed side provided in the print head 1 so as to keep the cap base 26 parallel with the nozzle surface 2 while being moved toward the nozzle surface 2 so as to describe an arc.

Figure 3:
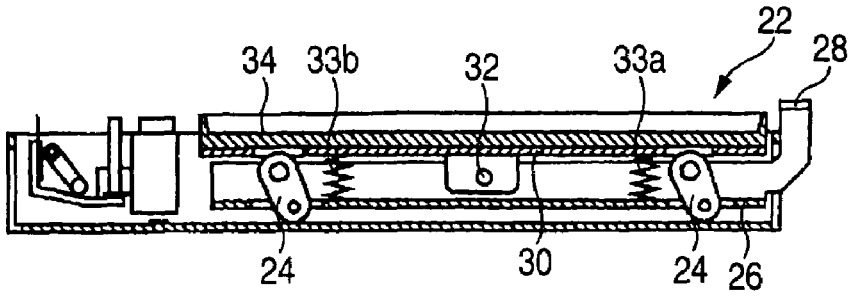
FIG. 3 is a sectional view taken on line 3-3 in FIG. 2.

A swinging base 30 is supported on the cap base 26 swingably around a pin 32 as shown in FIG. 3. On each of opposite sides of the pin 32, a coil spring 33*a*, 33*b* is disposed between the cap base 26 and the swinging base 30. Four print head caps 34 (hereinafter referred to as "caps 34") are attached to the swinging base 30 correspondingly to the respective colors of the print head 1 in this embodiment. The caps 34 are formed out of an elastically deformable material, particularly a material resistant to ink, such as butyl rubber or EPDM.

A bottom surface 36 opposed to the nozzle surface 2 is formed in the cap 34 as shown in FIG. 3. The bottom surface 36 is substantially flat, and an exhaust hole 38 opened in the bottom surface 36 is formed in the cap 34. The exhaust hole 38 is designed to be connected to a not-shown exhaust duct so as to be able to exhaust ink.

In each cap 34, a lip 40 is provided to surround the bottom surface 36 like a ring. The lip 40 protrudes toward the nozzle surface 2 of the print head 1. In this embodiment, the lip 40 has a pair of side lips 40*a* and 40*b* provided linearly along the long sides of the bottom surface 36, and a pair of side lips 40*c* and 40*d* provided linearly along the short sides of the bottom surface 36.

Figure 5:
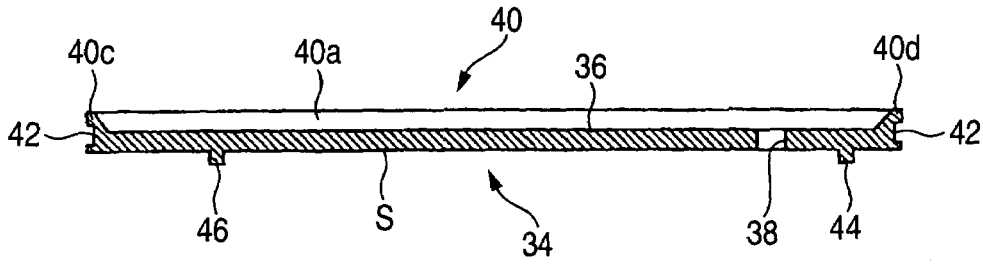
FIG. 5 is a sectional view taken on line 5-5 in FIG. 4.
Figure 6:
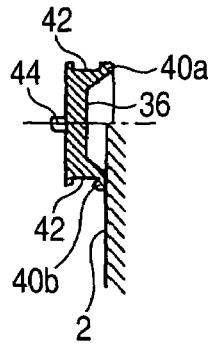
FIG. 6 is a sectional view taken on line 6-6 in FIG. 4.

Each side lip 40*a*-40*d* is formed into a tapered shape having a sectional shape thicker on the bottom surface 36 side and thinner gradually as the location goes toward the front end of the side lip 40*a*-40*d*, as shown in FIGS. 5 and 6. Incidentally, the shape of the side lip 40*a*-40*d* is not limited to the linear shape, but it may be a curved shape describing a gentle arc or the like.

Figure 4:
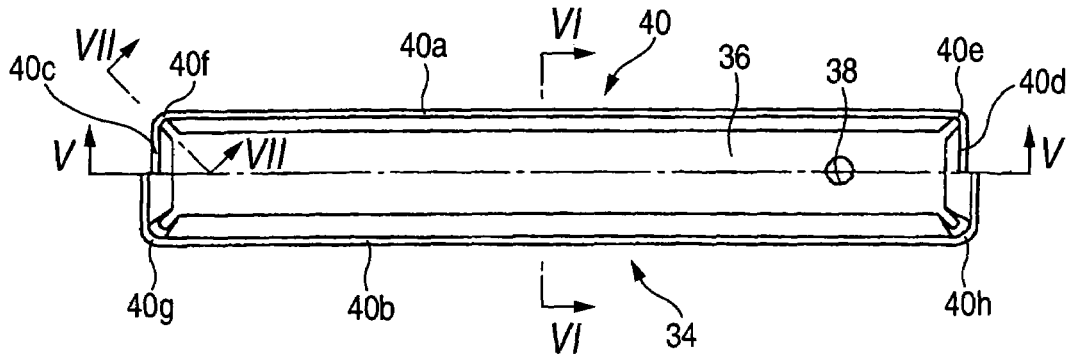
FIG. 4 is a plan view of the print head cap according to the embodiment.
Figure 7:
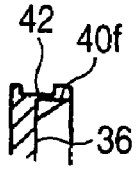
FIG. 7 is a sectional view taken on line 7-7 in FIG. 4.

Of the corners of the lip 40 in which the direction of surrounding the bottom surface 36 changes, in this embodiment, each corner in which the direction changes at the angle of 90 degrees from the side lip 40*a*, 40*b* along the long side to the side lip 40*c*, 40*d* along the short side connects the side lips 40*a*-40*d* with each other through a corner lip 40*e*-40*h* formed out of an arc. The corner lip 40*e*-40*h* is formed to have the same height from the mounting surface S as the height of the side lip 40*a*-40*d*. In this embodiment, the corner lip 40*e*-40*h* is formed to have the same thickness in its sectional shape as that of the front end of the side lip 40*a*-40*d* as shown in FIG. 7. The corner lip 40*e*-40*h* is formed to be easier to be elastically deformable than the side lip 40*a*-40*h*. FIGS. 4 and 6 shows the state of the lower side than the center line where the cap 34 has been pressed onto the nozzle surface 2 and thereby deformed. Incidentally, if the corner lip 40*e*-40*h* is thinner than the side lip 40*a*-40*d*, it will be easier to be elastically deformed, and then the embodiment can be carried out.

A groove 42 is formed all over the circumference outside the side lips 40*a*-40*d* and the corner lips 40*e*-40*h*. When each front end of the side lips 40*a*-40*d* and the corner lips 40*e*-40*h* is pressed onto the nozzle surface 2, the front end is urged to be deformed due to the groove 42 as shown in FIG. 6. Incidentally, protrusions 44 and 46 for positioning the cap 34 when it is attached to the swinging base 30 are formed on the back surface of the cap 34.

Next, description will be made on the operation of the print head cap according to this embodiment.

At the time of printing, the belt 10 is driven by the rotations of the rollers 8 so that printing paper passes under the print head 1 at a fixed speed. Then, ink droplets are ejected from the print head 1 so that printing is performed line by line.

At the time of maintenance for recovering the nozzles of the print head 1 from clogging or keeping the nozzles of the print head 1 moist, the print head 1 is moved from the ink ejection position to the standby position as shown by the arrow in FIG. 1 so that a predetermined space is formed between the print head 1 and the belt 10. Then, driven by the belt 19, the mounting base 12 is guided along the guide bars 14 and 16 and inserted into the space between the print head 1 and the belt 10.

When each engagement portion 28 abuts against the fixed side of the printer, and the mounting base 12 is moved further, the cap base 26 is moved to describe an arc from the separation position shown in FIG. 3 toward the nozzle surface 2 by the plurality of links 24 while retaining its parallelism with the nozzle surface 2. Then, the cap 34 is pressed onto the nozzle surface 2. In that event, the swinging base 30 swings around the pin 32 so as to press the cap 34 onto the nozzle surface 2 by uniform pressing force.

When the cap 34 is pressed onto the nozzle surface 2, each side lip 40*a*-40*d* is elastically deformed as if the front end thereof falls down to the inside of the groove 42 as shown in FIG. 6. Then, each corner lip 40*e*-40*h* is elastically deformed as if the front end of the corner 40*e*-40*h* falls down to the inside of the groove 42 similarly. At the same time, the arc-like circumferential length of the corner lip 40*e*-40*h* connecting the front ends of the side lips 40*a*-40*d* on the opposite sides of the corner lip 40*e*-40*h* is elongated because the front ends of the side lips 40*a*-40*d* fall down to expand outward. Since the corner lip 40*e*-40*h* is formed to be easy to be elastically deformed, the corner lip 40*e*-40*h* expands in its circumferential direction.

Accordingly, when the cap 34 is pressed onto the nozzle surface 2, as shown in FIGS. 4 and 6, the front ends of the side lips 40*a*-40*d* fall down outward, and the front ends of the corner lips 40*e*-40*h* fall down outward while expanding in their circumferential directions respectively. Thus, the front ends of the side lips 40*a*-40*d* and the corner lips 40*e*-40*h* are brought into tight contact with the nozzle surface 2 so as to cover the nozzle surface 2 air-tightly with the bottom surface 36, the side lips 40*a*-40*d* and the corner lips 40*e*-40*h*.

After that, ink is ejected from the print head 1 for the sake of recovery of the nozzles or the like. In that event, since the nozzles are covered air-tightly with the bottom surface 36, the side lips 40*a*-40*d* and the corner lips 40*e*-40*h*, there is no fear that the ink leaks out. Incidentally, not only at the time of recovery but also at any time when printing is not carried out, the cap 34 is pressed onto the nozzle surface 2 so as to keep the nozzle surface 2 moist.

Since the corner lips 40*e*-40*h* are formed to be easy to be elastically deformed in such a manner, it is possible to retain air-tightness. In addition, since the corner lips 40*e*-40*h* are elastically deformed to retain the air-tightness, the tolerance for dimensional accuracy is so large that the number of caps 34 defective in dimensions can be reduced. Thus, the yield in manufacturing can be improved.

Next, description will be made on a print head cap according to a second embodiment different from the aforementioned embodiment, with reference to FIGS. 8 to 10, 11A and 11B. Members the same as those in the aforementioned embodiment are denoted by the same reference numerals correspondingly, and their detailed description will be omitted.

Figure 8:
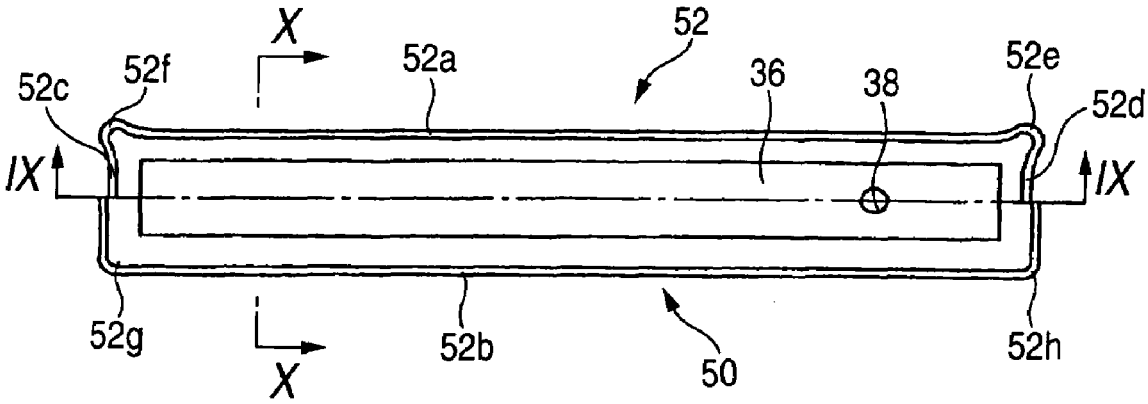
FIG. 8 is a plan view of a print head cap according to a second embodiment of the invention.

As shown in FIG. 8, in a cap 50, a bottom surface 36 is formed to be opposed to the nozzle surface 2. The cap 50 is provided with a lip 52 surrounding the bottom surface 36 like a ring. The lip 52 protrudes toward the nozzle surface 2 of the print head 1. In this embodiment, the lip 52 has a pair of side lips 52*a* and 52*b* provided linearly along the long sides of the bottom surface 36, and a pair of side lips 52*c* and 52*d* provided linearly along the short sides of the bottom surface 36. Also in this case, the shape of the side lip 52*a*-52*d* is not limited to the linear shape, but may be a curved shape.

Figure 9:
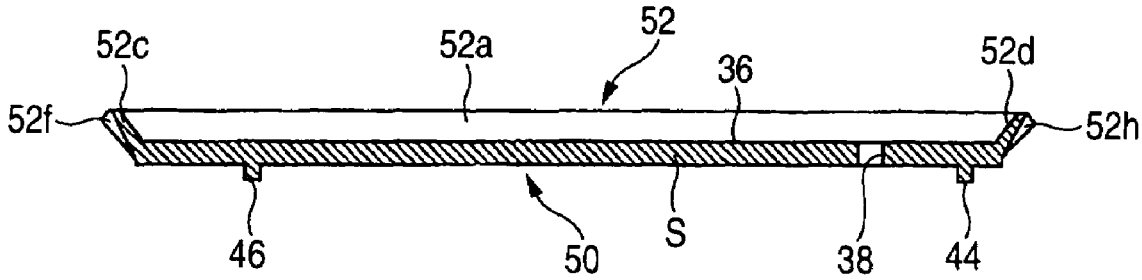
FIG. 9 is a sectional view taken on line 9-9 in FIG. 8.
Figure 10:
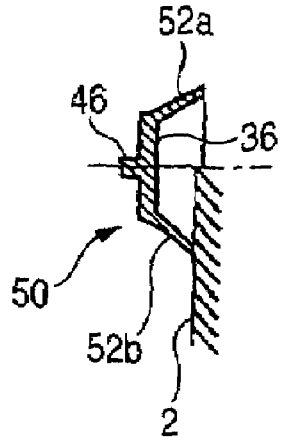
FIG. 10 is a sectional view taken on line 10-10 in FIG. 8.

Each side lip 52*a*-52*d* is formed to have a sectional shape protruding obliquely from the bottom surface 36 side toward the nozzle surface 2, and to have a front end opened to the outside so as to overhang the bottom surface 36, as shown in FIGS. 9 and 10. The side lip 52*a*-52*d* is formed to have a substantially uniform thickness between the bottom surface 36 side and the front end side or a thickness reduced slightly as the location goes toward the front end.

Figure 11A:
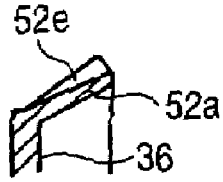
FIGS. 11A and 11B are explanatory views showing the falling of a lip of the print head cap according to the second embodiment.

Of the corners of the lip 52 in which the direction of surrounding the bottom surface 36 changes, in this embodiment, each corner in which the direction changes at the angle of 90 degrees from the side lip 52*a*, 52*b* along the long side to the side lip 52*c*, 52*d* along the short side connects the side lips 52*a*-52*d* with each other through each corner lip 52*e*-52*h*. The corner lip 52*e*-52*h* is formed into an arc-like shape swelling outside the corner where the extensions of the side lips 52*a*-52*d* cross each other, as shown in FIG. 8. As shown in FIG. 9 and 11A, the corner lip 52*e*-52*h* is formed to protrude obliquely further outside the side lip 52*a*-52*d* between the bottom surface 36 and its front end.

In addition, the corner lip 52*e*-52*h* is formed to be lower in height (height from the mounting surface S) than the side lip 52*a*-52*d*. The corner lip 52*e*-52*h* is formed to be the lowest at the intermediate point of its arc and to be inclined toward the front end of the side lip 52*a*-52*d* on either side so as to be equal in height to the side lip 52*a*-52*d*. The height of the corner lip 52*e*-52*h* may be determined by experiment or the like so that the height of the corner lip 52*e*-52*h* becomes equal to that of the side lip 52*a*-52*d* due to the deformation of the cap 50 when the cap 50 is pressed onto the nozzle surface 2. Incidentally, FIGS. 8 and 10 show the state of the lower side than the center line where the cap 50 has been pressed onto the nozzle surface 2 and deformed.

Next, description will be made on the operation of the print head cap according to this second embodiment.

Figure 11B:
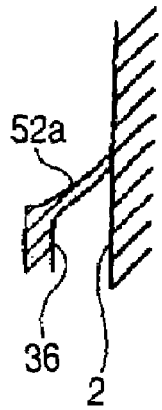

When the cap 50 is pressed onto the nozzle surface 2, each side lip 52*a*-52*d* is elastically deformed as if it falls down outward as shown in FIGS. 8, 10 and 11B. Thus, the height of the side lip 50*a*-50*d* is lowered. On the other hand, each corner lip 52*e*-52*h* falls down outward similarly together with the side lip 52*a*-52*d* on either side on the side lip 52*a*-52*d* side. The corner lip 52*e*-52*h* does not fall down very much in its intermediate portion. Thus, the height of the corner lip 52*e*-52*h* is not lowered.

Accordingly, when the cap 50 is pressed onto the nozzle surface 2, the height of the side lip 52*a*-52*d* and the height of the corner lip 52*e*-52*h* become substantially equal to each other so as to be brought into tight contact with the nozzle surface 2 with no space therebetween. Thus, the nozzle surface 2 is covered air-tightly with the bottom surface 36, the side lips 52*a*-52*d* and the corner lips 52*e*-52*h*.

In such a manner, the cap 50 is formed so that the side lips 52*a*-52*d* are deformed to be equal in height to the corner lips 52*e*-52*h*. Thus, it is possible to retain air-tightness. In addition, since the air-tightness is retained due to deformation of the side lips 52*a*-52*d*, the tolerance for dimensional accuracy is so large that the number of caps 50 defective in dimensions can be reduced. Thus, the yield in manufacturing can be improved.

The invention is not limited to the embodiments described above, but it can be carried out in various modes without departing from the gist of the invention.

As has been described in detail above, the print head cap 34 and 52 according to embodiments of the invention is formed so that the corner lips 40*e*-40*h* and 52*e*-52*h* are easy to be elastically deformed. Thus, it is possible to retain air-tightness. In addition, since the air-tightness is retained due to the elastic deformation of the corner lips 40*e*-40*h* and 52*e*-52*h*, the tolerance for dimensional accuracy is so large that the number of defective caps in dimensions can be reduced. Thus, there is an advantage that the yield in manufacturing can be improved. Particularly, when a groove 42 is formed outside the lip 40, the elastic deformation is urged so that the air-tightness can be retained more surely.

In addition, in the print head cap 52, the side lips 52*a*-52*d* are deformed to have the same height as the corner lips 52*e*-52*h*, so that the air-tightness can be retained. In addition, since the air-tightness is retained due to the deformation of the side lips 52*a*-52*d*, the tolerance for dimensional accuracy is so large that the number of defective caps in dimensions can be reduced. Thus, there is an advantage that the yield in manufacturing can be improved.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

What is claimed is:

1. A print head cap comprising:

a bottom surface; and a ring-like lip surrounding the bottom surface like a ring, protruding toward a nozzle surface of a print head of an ink jet printer and being elastically deformable, the ring-like lip to be pressed onto the nozzle surface to cover the nozzle surface therewith;

wherein the ring-like lip has corners that change a direction of surrounding the bottom surface and includes a distal end and a groove that urges the distal end to be deformed in an outer side of the ring-like lip, the groove extending vertically and perpendicular to the bottom surface, and the distal end falling downward to an inside of the groove when a print head cap is pressed onto the nozzle surface; and the corners are more elastically deformable than other portions of the ring-like lip, and the corners are made thinner than the other portion.

2. The print head cap according to claim 1, wherein the other portion includes a plurality of side lips;

at least one of the corners includes a corner lip; and the corner lip connects the side lips with each other.

3. The print head cap according to claim 2, wherein each of the side lips has a front end and is formed into a tapered sectional shape which is smaller in width as a location goes from the bottom surface toward the front end; and the corner lip has substantially the same height as the side lips and is smaller than the side lips in thickness.

4. The print head lip according to claim 2, wherein the ring-like lip is formed into a rectangular shape; and the side lips include a pair of linear side lips on long sides and a pair of linear side lips on short sides.

5. A print head cap comprising:

a bottom surface; and a ring-like lip surrounding the bottom surface like a ring, protruding toward a nozzle surface of a print head of an ink jet printer and being elastically deformable, the ring-like lip to be pressed onto the nozzle surface to cover the nozzle surface therewith;

wherein the ring-like lip has corners that change a direction of surrounding the bottom surface and includes a distal end and a groove that urges the distal end to be deformed in an outer side of the ring-like lip, the groove extending vertically and perpendicular to the bottom surface; and the corners are more elastically deformable than other portions of the ring-like lip, and the corners are made thinner than the other portion.

6. A print head cap for covering a nozzle surface of an ink jet printer, the print head cap comprising;

a bottom surface;

a plurality of side walls which are elastically deformable, provided along respective edges of the bottom surface so as to ring the bottom surface, and extending from the respective edges of the bottom of the surface toward the nozzle surface, the plurality of side walls comprising a plurality of corner members, each of the corner members connecting two adjacent side walls of the plurality of side walls, the corner members being more elastically deformable and being thinner than the side walls; and a groove which is provided in an outside surface of the plurality of side walls, and formed between a distal end and a proximal end of each side wall in a direction of the nozzle surface.

7. The print head cap according to claim 6, wherein the groove comprises a notch which extends perpendicularly and vertically into the outside surface of the plurality of side walls.

8. The print head cap according to claim 7, wherein the notch comprises a top cut, a bottom cut, and a back wall, the top cut being spaced from the proximal end of the side walls and the bottom cut being spaced from the distal end of the side walls, and the back wall being parallel to the outside surface of the side walls.

9. The print head cap according to claim 6, wherein each of the plurality of side walls comprises a side lip which is provided at the distal end of the side wall.

10. The print head cap according to claim 9, wherein when the side lips of the print head cap are placed against the nozzle surface and a pressure is applied to the print head cap in a direction of the nozzle surface, the distal end of the side walls deforms outward such that a position of the plurality of side lips moves into the groove.

11. The print head cap according to claim 6, wherein the plurality of side walls are flared outward in the direction of the nozzle surface.

12. A print head cap for covering a nozzle surface of a print head of an ink jet printer, the print head cap comprising;

a bottom surface;

a lip surrounding the bottom surface like a ring, protruding toward the nozzle surface of the print head and being elastically deformable, the lip comprising corners that change a direction surrounding the bottom surface and that are more elastically deformable and thinner than other portions of the lip; and means, which is provided in the lip, for urging a distal end of the lip to be deformed towards an outer side of the lip when a print head cap is pressed onto the nozzle surface.

13. The print head cap according to claim 12, wherein the means for urging also urges a distal end of the corners to be deformed toward an outer side of the corners when a print head cap is pressed onto the nozzle surface.

* * * * *